United States Patent [19]

Hoyle et al.

[11] Patent Number: 4,897,226

[45] Date of Patent: Jan. 30, 1990

[54] CARBON DIOXIDE STORAGE AND DISPENSING APPARATUS AND METHOD

[75] Inventors: Michael D. Hoyle, Arlington, Tex.; Charles V. Snyder, East Mobile, Ala.

[73] Assignee: Carbonic Technologies, Inc., Arlington, Tex.

[21] Appl. No.: 323,897

[22] Filed: Mar. 15, 1989

[51] Int. Cl.[4] ..... B01F 3/04

[52] U.S. Cl. ..... 261/129; 261/115; 261/88; 261/142; 261/DIG. 7; 261/130; 261/131; 141/11; 141/70; 220/901; 239/403

[58] Field of Search ..... 141/70, 11; 261/115, 261/DIG. 7, 88, 140.1, 142, 129, 130, 131; 220/85 F, 901, 5 A; 239/403

[56] References Cited

U.S. PATENT DOCUMENTS

| | | | |
|---|---|---|---|
| 1,098,389 | 6/1914 | Lister | 261/88 |
| 1,420,722 | 6/1922 | MacLachlan | 261/88 |
| 2,473,035 | 6/1949 | Meade et al. | 261/88 |
| 2,650,808 | 9/1953 | Cohen et al. | 239/403 |
| 3,034,730 | 5/1962 | Pilo et al. | 261/88 |
| 3,100,810 | 8/1963 | Meyer | 261/115 |
| 3,274,788 | 9/1966 | Hoffman et al. | 220/901 |
| 3,291,463 | 12/1966 | Rousseau et al. | 261/115 |
| 3,534,944 | 10/1970 | Pahl et al. | 261/115 |
| 4,115,072 | 9/1978 | Nielsen | 261/115 |
| 4,821,907 | 4/1989 | Castles et al. | 220/5 A |

*Primary Examiner*—Tim Miles
*Attorney, Agent, or Firm*—John M. Harrison

[57] ABSTRACT

A carbon dioxide storage and dispensing apparatus and method for storing carbon dioxide which is characterized by a pressure vessel designed to hold carbon dioxide liquid and vapor, which pressure vessel is insulated to control heat input and includes a refrigeration system, fill and withdrawal piping, a fill line mixer provided in the fill line for rapidly mixing incoming liquid carbon dioxide with carbon dioxide in the vapor phase, a volume gauge, heating rod for introducing heat into the vessel and associated operating and safety control devices. The pressure vessel may be characterized by a horizontal or vertical tank and is designed to provide the user with an uninterrupted supply of carbon dioxide gas or liquid, while at the same time overcoming many of the problems associated with currently available carbon dioxide storage and dispensing equipment. A primary feature of the carbon dioxide storage and dispensing apparatus of this invention is the fill line mixer, which facilitates rapid intermixing of the gas phase fluid with the liquid phase introduced into the vessel during filling, in such a manner as to rapidly promote equilibrium conditions and resulting minimum pressure and temperature rise during filling, to eliminate carbon dioxide losses.

31 Claims, 1 Drawing Sheet

CARBON DIOXIDE STORAGE AND DISPENSING APPARATUS AND METHOD

BACKGROUND OF THE INVENTION

1. Field of the Invention

This invention relates to pressure vessels and techniques for storing and dispensing carbon dioxide in the liquid and vapor phase and more particularly, to a carbon dioxide storing and dispensing apparatus and method for storing liquid and gaseous carbon dioxide, for supplying restaurants and other users of the gas. The carbon dioxide storage and dispensing apparatus of this invention is characterized by a horizontal or vertically oriented tank or pressure vessel adapted to receive and store liquid and gaseous carbon dioxide, which vessel is provided with insulation for controlling heat input. A refrigeration system, fill and withdrawal piping, a fill line mixer, volume gauge, heating rod and associated operating and safety control devices are also provided, to complete the system. The carbon dioxide storage and dispensing apparatus is designed to provide a user with an uninterrupted supply of carbon dioxide gas or liquid, while at the same time facilitating storage of larger quantities of carbon dioxide with minimum loss and overcoming other problems associated with presently available equipment and methods.

2. Description of the Prior Art

Current carbon dioxide storage and dispensing systems are characterized by high pressure (800–3000 psig) gas cylinders and low pressure (125–300 psig) liquid cylinders. The high pressure gas system has been in use for many years and has proved to be capable of providing reasonable service with minimum inconvenience to the customer. Replenishment of carbon dioxide in the gas-phase system is accomplished by either switching full cylinders or tanks for empty ones, or filling the end-user cylinders from a delivery vehicle with a high pressure pump under closely controlled conditions. Under circumstances where carbon dioxide is supplied by switching out cylinders, a large inventory of equipment is necessary to service a single customer and high gas losses are experienced by the users, as a result of disconnecting lines and returning partially filled containers to the servicing company. Disconnection also leads to interrupted service, with associated safety and cleanliness problems.

More recently, the use of cryogenic containers (containers fabricated specifically for use at temperatures below −20° F.) have been introduced into carbon dioxide service. These units are preferably stored permanently at the restaurant or other end user location and filled upon demand from a delivery truck, usually by the pressure differential which exists between the container and the delivery unit. This system eliminates the necessity of substituting cylinders, with the accompanying leaks and fluid losses associated with the high pressure cylinder application. However, by nature, the low temperature devices must be designed for very low heat transfer to the stored fluid, in order to minimize pressure build-up and subsequent venting of fluid during low or no-use periods. Accordingly, these systems generally require high performance insulation and a vacuum bottle-type of construction.

The task of filling high pressure carbon dioxide containers, tanks and bottles at a user's site to safe levels and maintaining suitable quantities of carbon dioxide vapor and liquid in the pressure containers at acceptable and safe internal pressures, has resulted in limited storage volume capability for carbon dioxide. Maintaining an acceptable level of container or pressure vessel vacuum over a suitable period of time is difficult and the minimum use rate without gas loss continues to increase beyond a small user's need, under ordinary circumstances. Conversely, the needs of the larger use periods requires the external addition of heat to the container, in order to maintain the minimum required pressure in the system. Pressure-building coils and related controls have been developed to achieve this end, thus introducing further maintenance and operational problems. Other problems such as the difficulty of properly filling a pressure vessel without prior venting to relieve the pressure and wasting carbon dioxide, further underscores the need for improvement.

An object of this invention is to provide a carbon dioxide storage and dispensing apparatus which includes an insulated storage vessel or tank provided with a fill line having a mixer mounted thereon inside the vessel for dispersing incoming liquid carbon dioxide in the vaprous carbon dioxide to achieve rapid vapor-liquid phase equilibrium.

It is another object of this invention to provide a carbon dioxide storage and dispensing apparatus and method for storing both liquid and vaporized carbon dioxide in an insulated pressure vessel to control heat input, using a refrigeration system, fill and withdrawal piping and a fill line mixer located inside the pressure vessel to rapidly achieve equilibrium between the gas and liquid phases.

Another object of the invention is to provide a permanently installed system for storing and dispensing liquid and vaporous carbon dioxide in a wide variety of carbon dioxide usage situations, which system combines wide use range capability with rapid filling capability to the maximum legal gas and liquid volume, without loss or inconvenience to the supplier or user.

Yet another object of the invention is to provide a new and improved carbon dioxide storing and dispensing apparatus which is characterized by an upright or horizontally-mounted insulated pressure vessel fitted with a fill line having a fixed or rotatable fill line mixer mounted inside the pressure vessel, wherein liquid carbon dioxide introduced through the fill line into the pressure vessel impinges upon the mixer to achieve rapid equilibrium between the gas and liquid carbon dioxide phases and minimize the pressure and temperature elevation in the pressure vessel.

Still another object of the invention is to provide a carbon dioxide storage and dispensing apparatus and method for storing and dispensing both gaseous and liquid carbon dioxide, which apparatus includes an insulated pressure vessel provided with a fill line and a fixed or rotatable mixer mounted in the fill line and located in the pressure vessel, in order to rapidly and efficiently mix the liquid and gaseous carbon dioxide, thereby achieving rapid equilibrium between the gaseous phase and liquid phase and minimize losses during filling, as well as achieve optimum pressure conditions inside the pressure vessel.

A further object of the invention is to provide a method for filling a carbon dioxide storage and dispensing apparatus with liquid carbon dioxide in an optimum manner, which includes the steps of introducing liquid carbon dioxide into a pressure vessel, providing a mixing device in the pressure vessel for receiving the liquid carbon dioxide and causing the liquid carbon dioxide to be dispersed in the gaseous carbon dioxide to achieve rapid equilibrium between the gas and liquid phases and maintain equilibrium pressure inside the pressure vessel.

SUMMARY OF THE INVENTION

These and other objects of the invention are provided in a new and improved carbon dioxide storage and dispensing apparatus and method for storing liquid and gaseous carbon dioxide in a pressure vessel, which includes an insulated upright or horizontally-mounted pressure vessel; a fill line extending into the pressure vessel and a fixed or rotatable mixing device mounted on the end of the fill line inside the pressure vessel, for receiving liquid carbon dioxide and dispersing the liquid carbon dioxide inside the pressure vessel and achieving rapid equilibrium between the gas and liquid carbon dioxide phases; a refrigeration system for controlling the internal temperature of the pressure vessel; a withdrawal piping system for selectively withdrawing liquid and gaseous carbon dioxide from the pressure vessel; a volume gauge; a heating rod for introducing heat into the pressure vessel; and associated safety control devices for monitoring pressure and temperature in the pressure vessel.

BRIEF DESCRIPTION OF THE DRAWING

The invention will be better understood by reference to the accompanying drawing, wherein.

DESCRIPTION OF THE PREFERRED EMBODIMENTS

Figure 1:
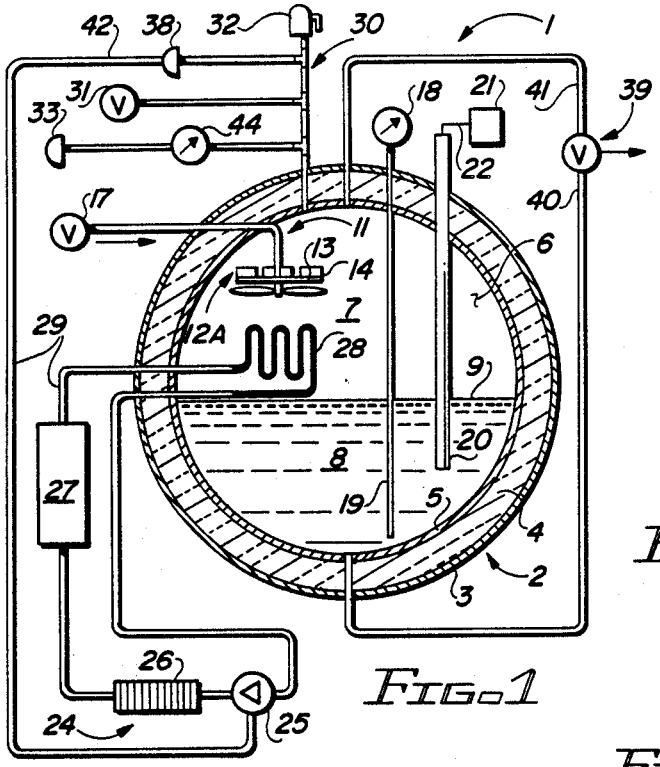
FIG. 1 is a schematic and sectional view of a horizontally-mounted pressure vessel, illustrating a preferred embodiment of the carbon dioxide storage and dispensing apparatus and method of this invention.
Figure 4:
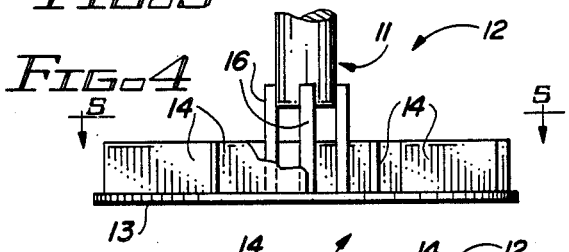
FIG. 4 is a side view, partially in section, of a fixed carbon dioxide mixer for attachment to the input or fill line inside a pressure vessel.
Figure 5:
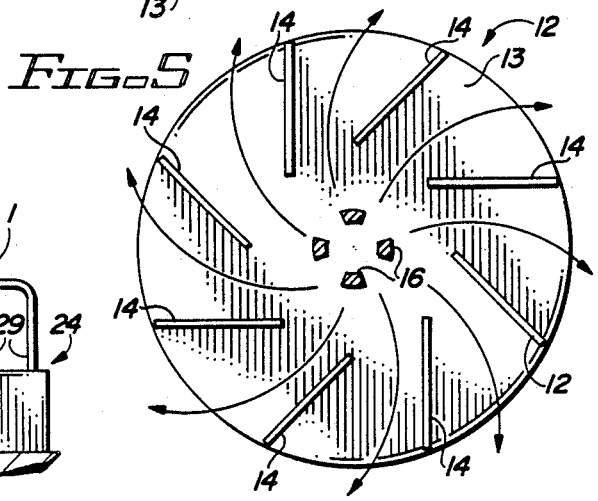
FIG. 5 is a sectional view taken along line 5—5 of the fixed carbon dioxide mixer illustrated in FIG. 4.
Figure 2:
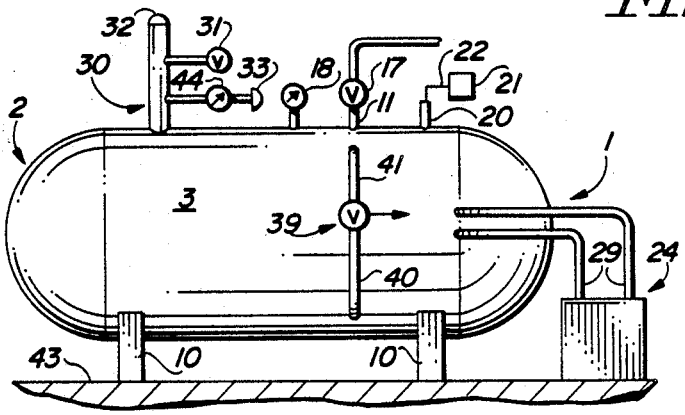
FIG. 2 is a side elevation of the horizontally-mounted pressure vessel illustrated in FIG. 1.
Figure 6:
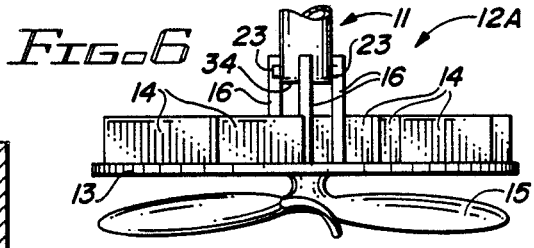
FIG. 6 is a side view of an alternative rotatable carbon dioxide mixer for use in the carbon dioxide storage and dispensing apparatus of this invention.

Referring initially to FIGURES 1, 2, 6 and 8 of the drawing, a horizontal carbon dioxide storage and dispensing apparatus is generally illustrated by reference numeral 1. The horizontal carbon dioxide storage and dispensing apparatus 1 includes a horizontally-mounted tank 2, supported by a pair of spaced tank supports 10, that rest on the flat surface 43, as illustrated in FIG. 2. As further illustrated in FIG. 1, the horizontal tank 2 is characterized by an outer shell 3 and an inner shell 5, provided with insulation 4 therebetween. The horizontal tank 2 is designed to provide a tank interior 6 of selected dimension, with a vapor space 7 for accommodating vaporized carbon dioxide and a volume of liquid carbon dioxide 8 filled to a liquid level 9 in the tank interior 6, as further illustrated in FIG. 1. A fill line 11 extends through the outer shell 3, inner shell 5 and insulation 4 of the horizontal tank 2, into the vapor space 7 of the tank interior 6 and a rotatable carbon dioxide mixer **12*a* is mounted on the extending end of the fill line 11 in the vapor space 7. In a first preferred embodiment of the invention the carbon dioxide mixer 12*a* is characterized by a mixer plate 13, provided with upward-standing mixing blades 14 that are arranged in angular relationship with respect to the radius of the mixing plate 13, as illustrated in FIGS. 4 and 5. Four mixer legs 16 extend upwardly from fixed attachment near the center of the mixer plate 13 and are rotatably attached to the fill line 11 by means of spaced bearings 23, which traverse a race collar 34, secured to the fill line 11, as further illustrated in FIG. 8. Accordingly, it will be appreciated that the mixer plate 13 and the mixer blades 14 are designed to rotate in concert with respect to the fill line 11 when liquid carbon dioxide is pumped through the fill line valve 17 and into the fill line 11 and impinges against the center of the mixer plate 13 inside the mixer legs 16, and then strikes the mixer blades 14 in angular relationship. This action disperses the liquid carbon dioxide into the gaseous carbon dioxide located in the vapor space 7 of the horizontal tank 2, in order to effect rapid vapor-liquid phase equilibrium in the tank interior 6, as hereinafter further described. In a most preferred embodiment of the invention, the carbon dioxide mixer 12 is fitted with a propeller 15 as illustrated in FIG. 6, which propeller 15 is fixedly attached to the mixer plate 13. Accordingly, when liquid carbon dioxide impinges on the mixer plate 13 through the fill line 11 as heretofore described, the propeller 15 is caused to rotate with the mixer plate 13 and the mixer blades 14, to further mix droplets of liquid carbon dioxide with the gaseous carbon dioxide in the vapor space 7 of the tank interior 6**.

Referring to FIGS. 4 and 5, in another preferred embodiment of the invention the mixer plate 13 and mixer blades 14 are fixed with respect to the fill line 11 by fixedly securing the upper ends of the mixer legs 16 to the discharge end of the fill line 11. This mechanical arrangement facilitates impingement of the liquid carbon dioxide on the mixer plate 13 and dispersion of the liquid carbon dioxide into the vapor space 7 by further contact between the liquid carbon dioxide droplets and the fixed mixer blades 14, to achieve rapid mixing of the gas and liquid phase carbon dioxide.

Referring again to FIGS. 1 and 2 of the drawing, in another preferred embodiment of the invention a volume gauge 18 is mounted on a volume gauge probe 19, which extends through the outer shell 3, inner shell 5 and insulation 4 into the tank interior 6, through the vapor space 7 and into the liquid carbon dioxide 8, as illustrated in FIG. 1. The volume gauge 18 serves to indicate the volume of liquid carbon dioxide 8 inside the tank interior 6. In another preferred embodiment of the invention, a heating rod 20 also extends through the outer shell 3, the inner shell 5 and the insulation 4 of the horizontal tank 2 and then through the vapor space 7, into the liquid carbon dioxide 8, as further illustrated in FIG. 1. A heater wire 22 connects the upper end of the heating rod 20 to a resistance heater 21, in order to introduce heat into the tank interior 6 and the liquid carbon dioxide 8, for purposes which will be hereinafter further described.

In yet another preferred embodiment of the invention and referring again to FIGS. 1 and 2 of the drawing, a cooling system 24 is provided for cooling the tank interior 6 of the horizontal tank 2. The cooling system 24 is characterized by a compressor 25, an evaporator 26 and a condensor 27, connected by the cooling lines 29. The cooling lines 29 extend through the outer shell 3, insulation 4 and inner shell 5 and a set of cooling coils 28 are disposed in the cooling lines 29 in the vapor space 7 of the tank interior 6. Furthermore, a control mast 30 projects through the outer shell 3, the inner shell 5 and the insulation 4 of the horizontal tank 2 and terminates in the vapor space 7 of the tank interior 6 and is used for mounting a safety valve 31, a pressure bleed valve 32, a pressure sensor 33 and a temperature gauge 44.

Figure 3:
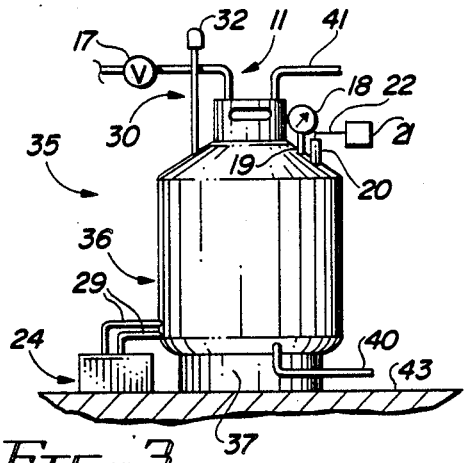
FIG. 3 is a side view of a typical upright carbon dioxide storage and dispensing apparatus.

Referring now to FIG. 3 of the drawing, in still another preferred embodiment of the invention an upright carbon dioxide storage and dispensing apparatus 35 is illustrated. The upright carbon dioxide storage and dispensing apparatus 35 includes a vertical tank 36, provided with a tank base 37 for resting on the flat surface 43. As in the case of the horizontal carbon dioxide storage and dispensing apparatus 1 illustrated in FIGS. 1 and 2, the upright carbon dioxide storage and dispensing apparatus 35 includes a fill line 11, provided with a fill line valve 17; a control mast 30, for mounting a safety valve, pressure sensor(s) and a temperature gauge (not illustrated) and a pressure bleed valve 32; a liquid carbon dioxide supply line 40 and vapor carbon dioxide supply line 41, served by a common carbon dioxide supply valve 39; a volume gauge 18 and companion volume gauge probe 19; as well as a heating rod 20, heater 21 and heater wire 22, for connecting the heating rod 20 to the heater 21.

Figure 7:
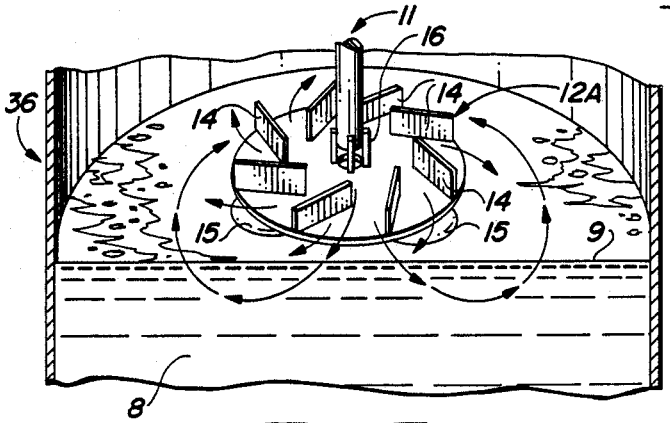
FIG. 7 is a perspective view of the rotatable carbon dioxide mixer illustrated in FIG. 6.
Figure 8:
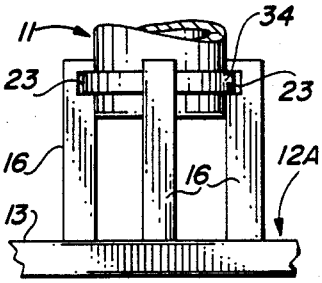
FIG. 8 is a side view of a preferred means for rotatably attaching the rotatable carbon dioxide mixer illustrated in FIGS. 4 and 6 to the end of the fill line extending into the pressure vessel.

In operation, the carbon dioxide storage and dispensing apparatus of this invention is utilized as follows. Referring again to the drawing, liquid carbon dioxide is first introduced into the horizontal tank 2 or the vertical tank 36 through the fill line valve 17 and the fill line 11 from a stationary source tank or tank truck (not illustrated), as illustrated in FIGS. 1 and 3 of the drawing. The liquid carbon dioxide is directed from the discharge end of the fill line 11 onto the mixer plate 13 of the fixed carbon dioxide mixer 12 illustrated in FIGS. 4 and 5, or the rotatable carbon dioxide mixer 12*a*, illustrated in FIGS. 1, 6 and 7. It is understood that either the fixed carbon dioxide mixer 12, illustrated in FIGS. 4 and 5, or the rotatable carbon dioxide mixer 12*a*, illustrated in FIGS. 1, 6 and 7, may be utilized in both the horizontal tank 2 and the vertical tank 36, as desired. In each case, impingement of the liquid carbon dioxide on the mixer plate 13 of the fixed carbon dioxide mixer 12 causes the liquid carbon dioxide to deflect in random manner against the mixer blades 14 and the gaseous carbon dioxide, to mix with the liquid carbon dioxide droplets, as the liquid carbon dioxide strikes the fixed mixer blades 14. Impingement of the liquid carbon dioxide on the mixer blades 14 of the rotatable carbon dioxide mixer 12*a* effects rotation of the mixer plate 13 and the mixer blades 14, as well as the propeller 15, in concert with respect to the fill line 11, by operation of the bearings 23 on the race collar 34. This rotation further disperses the liquid carbon dioxide in small droplets into the tank interior 6, where some of the liquid carbon dioxide vaporizes to occupy the vapor space 7. As liquid carbon dioxide continues to flow into the tank interior 6 through the fill line 11, continued splashing of the liquid carbon dioxide into the vapor space 7 of the tank interior 6 assures rapid and complete mixing of the fluid and thus promotes rapid equilibrium between the two carbon dioxide phases. This technique is extremely important, in order to eliminate a normal pressure rise in the tank interior 6 which would otherwise occur if equilibrium was not rapidly reached between the two carbon dioxide phases. Since the pressure does not rapidly rise inside the tank interior 6 using this technique, it is not necessary to vent the horizontal tank 2 or vertical tank 36, in order to facilitate introduction of additional liquid carbon dioxide into the tank interior 6. Introduction of liquid carbon dioxide into the tank interior 6 through the fill line 11 results in the accumulation of liquid carbon dioxide 8 to the liquid level 9 illustrated in FIG. 1 and although the liquid level 9 is illustrated at approximately the half-way fill volume in the tank interior 6, it will be appreciated by those skilled in the art that this level will vary, depending upon the size of the container, temperature considerations and like parameters. The volume of liquid carbon dioxide 8 in the tank interior 6 is monitored by the volume gauge 18, fitted with the volume gauge probe 19.

In a most preferred embodiment of the invention and as illustrated in FIG. 1, the horizontal tank 2 and vertical tank 36 are each provided with "atmosphere" type insulation 4, in order to control the heat input into the tank interior 6. While the exact nature of the insulation 4 used in the horizontal tank 2 and the vertical tank 36 is not important, various types of material such as polystyrene and polyurethane, as well as fibrous materials such as fiberglass, may be used, in non-exclusive particular. It is desirable that the insulation 4 have a thermal conductivity which is equal to or lower than that of air. The insulation 4 controls the amount of heat transferred from the atmosphere into the tank interior 6 and maintains that heat transfer at a level that can be removed by operation of the cooling system 24. Accordingly, during long periods of storage and use, the cooling system 24 can be operated in conventional manner to the extent necessary to maintain the temperature of the tank interior 6 and the liquid carbon dioxide 8 at a desired level, in order to facilitate adequate tank pressure for product use and safe operation during periods of high use. The cooling system 24 is conventional in design and is operated by activating the compressor 25, evaporator 26 and condensor 27 in conventional fashion to cool the cooling coils 28 by circulating a suitable coolant such as a "Freon" compound through the cooling lines 29. It has been found by way of example, that on a 40-gallon horizontal tank 2 or vertical tank 36, two inches of polyurethane insulation located between the outer shell 3 and the inner shell 5 is sufficient to control the heat load to such a value that sufficient heat is provided from the atmosphere to maintain the tank interior pressure at the initial fill pressure, which is normally about 300 psig. This allows an adequate withdrawal rate of liquid or vaporous carbon dioxide from the liquid carbon dioxide supply line 40 and the vapor carbon dioxide supply line 41 through the carbon dioxide supply valve 39, which withdrawal rate is typically about 9 pounds of carbon dioxide per hour.

During periods of long-term storage of liquid carbon dioxide without withdrawal by a user, heat is absorbed by the liquid carbon dioxide 8 and the pressure inside the vapor space 7 of the tank interior 6 rises. Without provision of a source of cooling such as the cooling system 24, the pressure in the tank interior 6 would rise to the point where it would expel vaporized carbon dioxide through the safety valve 31 at a pressure ranging from about 350–600 psig. This gas expulsion would lower the pressure in the tank interior 6 and further cool the liquid carbon dioxide 8. However, under circumstances where the cooling system 24 is utilized, the system can be thermostatically controlled by a suitable pressure sensor 38 through a pressure sensor line 42, provided in communication with the cooling system 24, as illustrated in FIG. 1, in order to utilize the cooling coils 28 to cool the tank interior 6 and the liquid carbon dioxide 8 and prevent such relief of pressure and loss of carbon dioxide vapor. This combined arrangement of the cooling system 24, the fixed carbon dioxide mixer 12 or the rotatable carbon dioxide mixer 12*a* and the insulation 4, along with the pressure sensor 38, facilitates essentially "no loss" filling and "no loss" storage of liquid and vaporous carbon dioxide for indefinite periods of time, with minimal automatic control requirements and without the requirement of adjustment by an operator.

Referring again to FIGS. 1–3 of the drawing, withdrawal of liquid and vaporized carbon dioxide is achieved from the horizontal tank 2 through the liquid carbon dioxide supply line 40 and the vapor carbon dioxide supply line 41, as heretofore described. Generally speaking, carbon dioxide vapor is withdrawn through the vapor carbon dioxide supply lie 41 using the carbon dioxide supply valve 39, as illustrated in FIGS. 1 and 2, for low end use purposes, such as may be required in restaurants and similar operations. Moreover, liquid carbon dioxide can be removed from the tank interior 6 through the liquid carbon dioxide supply line 40, by manipulating the carbon dioxide supply valve 39 for high end use applications, such as in firefighting equipment and the like. Withdrawal of either liquid or vaporous carbon dioxide can be automatically activated by the pressure sensor 33, mounted on the control mast 30, according to the knowledge of those skilled in the art. For example, if the pressure in the tank interior 6 should begin to drop rapidly to an undesirable level, the pressure sensor 33 will operate through suitable automation (not illustrated) to manipulate the carbon dioxide supply valve 39, such that the flow of vaporized carbon dioxide through the supply line 41 terminates and liquid carbon dioxide begins to flow through the liquid carbon dioxide supply line 40. Additional fluid withdrawal will be in the liquid phase through the liquid carbon dioxide supply line 40, to stop further pressure reduction in the tank interior 6.

Using the carbon dioxide storage and dispensing apparatus and method of this invention, it is possible to provide a higher allowable flow rate than is possible with conventional systems, without experiencing excessive pressure drop during gas phase withdrawal, by use of the heating rod 20 and heater 21. The heating rod 20 may be manufactured of any desired material such as copper or aluminum, having a relatively high conductivity, with a cross-section sufficiently large to adjust the heat flow into the liquid carbon dioxide 8 at a suitable rate. The heating rod 20 thus facilitates introduction of additional heat into the liquid carbon dioxide 8 and therefore maintains the pressure in the tank interior 6 at a higher withdrawal rate than is possible without using the heating rod 20. This expedient thus maintains a desirable pressure in the tank interior 6 of both the horizontal tank 2 and the vertical tank 36 and may be closely controlled by operation of the resistance heater 21, which supplies heat to the heating rod 20 through the heater wire 22.

Referring again to FIGS. 4 and 5 of the drawing, location of the fixed carbon dioxide mixer 12 and the rotatable carbon dioxide mixer 12*a* on the discharge end of the fill line 11 causes the liquid carbon dioxide to impinge on the mixer plate 13 at a relatively high velocity, where the fluid must make a sharp turn and flow radially outwardly toward the mixer blades 14. This sharp deflection tends to lower the pressure in the area of impingement and causes a flow of carbon dioxide vapor into that area, thus rapidly combining the gas and liquid phases. The mixed liquid and gas phase fluid then moves into the mixer blades 14, where it is again forced to turn or deflect, thereby imparting a swirl to the mixture as it is forced toward the inner shell 5 of the tank interior 6 and causing additional turbulence in mixing, bringing the contained mass of fluid into rapid equilibrium. This action is accentuated in the rotatable carbon dioxide mixer 12*a* and rapidly brings the contained fluid to an equilibrium pressure, which is a naturally weighted average of the saturation pressure of the charging liquid carbon dioxide (about 250–300 psig) and fluid already in the tank interior 6 at the beginning of the fill operation, normally about 200–345 psig. Under these circumstances, the pressure in the vapor space 7 of the tank interior 6 will normally be maintained in a pressure of about 300 psig. For example, and referring now to FIGS. 6 and 7 of the drawing, under circumstances where the rotatable carbon dioxide mixer 12*a* is used, the rotating mixer plate 13 and mixer blades 14, along with the propeller 15, effect impingement of the liquid carbon dioxide against the mixer plate 13 and rotation of the mixer plate 13, the mixer blades 14 and the propeller 15. This combined impingement action of the carbon dioxide liquid and gas, along with the rotating action of the mixer plate 13, mixer blades 14 and the propeller 15, causes rapid fluid circulation throughout the vapor space 7 of the tank interior 6 and effects corresponding rapid thermal equilibrium. The thermal equilibrium brings the contained carbon dioxide into equilibrium pressure, as described above.

It will be appreciated by those skilled in the art that the carbon dioxide storage and dispensing apparatus and method of this invention provide a highly desirable apparatus and technique for receiving, storing and using liquid and vaporous carbon dioxide with minimal losses during filling, extended use and storage, as well as rapid end use, which has not been available in the past. Both the horizontal tank 2 and the vertical tank 36 are normally installed in a permanent manner at a use site and liquid carbon dioxide is delivered to the use site in conventional motor carriers for charging purposes. Liquid carbon dioxide can be charged into the vessel using conventional transfer lines and the fixed carbon dioxide mixer 12 and rotatable carbon dioxide mixer 12*a* serve to rapidly achieve equilibrium conditions and facilitate more expeditious storing conditions at higher volumes of gas and liquid for ready use. The system can be served by conventional motor carriers for charging purposes and affords optimum storage and dispensing facilities without excessive instrumentation and controls and without loss of carbon dioxide to any appreciable extent, since no bleeding of the gas is necessary during the filling operation. The refrigeration embodiment insures against gas loss from excessive pressure during long-term carbon dioxide storage, and use of the heat rod facilitates steady gas phase use with little or no change in the container pressure. High rates of withdrawal of both gaseous and liquid carbon dioxide may be effected due to the thermally balanced contents, especially resulting from rapid mixing of the incoming liquid phase by use of the fixed carbon dioxide mixer 12 and the rotatable carbon dioxide mixer 12*a*.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A carbon dioxide storage and dispensing apparatus comprising a vessel adapted to contain liquid and gaseous carbon dioxide; at least one fill line extending into said vessel, with the discharge end of said fill line terminating inside said vessel and the supply end of said fill line connected to a source of liquid carbon dioxide; and mixer means carried by said discharge end of said fill line, whereby impingement of liquid carbon dioxide against said mixing means dispenses said liquid carbon dioxide in said gaseous carbon dioxide in said vessel and effects rapid equilibrium between said liquid carbon dioxide and said gaseous carbon dioxide.

2. The carbon dioxide storage and dispensing apparatus of claim 1 wherein said mixer means further comprises a mixer plate disposed beneath said discharge end of said fill line; connecting means joining said mixer plate to said discharge end in fixed relationship; and a plurality of mixer blades fixedly attached to said mixer plate for receiving the liquid carbon dioxide from said fill line and dispersing said liquid carbon dioxide into said gaseous carbon dioxide.

3. The carbon dioxide storage and dispensing apparatus of claim 1 further comprising a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel.

4. The carbon dioxide storage and dispensing apparatus of claim 1 further comprising a heating rod extending into said vessel and into said liquid carbon dioxide for heating said liquid carbon dioxide.

5. The carbon dioxide storage and dispensing apparatus of claim 1 further comprising:

(a) a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel; and (b) a heating rod extending into said vessel and into said liquid carbon dioxide for heating said liquid carbon dioxide.

6. The carbon dioxide storage and dispensing apparatus of claim 5 wherein said mixer means further comprises a mixer plate disposed beneath said discharge end of said fill line; connecting means joining said mixer plate to said discharge end in fixed relationship; and a plurality of mixer blades fixedly attached to said mixer plate for receiving the liquid carbon dioxide from said fill line and dispersing said liquid carbon dioxide into said gaseous carbon dioxide.

7. The carbon dioxide storage and dispensing apparatus of claim 1 further comprising refrigeration means having refrigeration coils located in said vessel for cooling said liquid carbon dioxide and said gaseous carbon dioxide.

8. The carbon dioxide storage and dispensing apparatus of claim 6 further comprising:

(a) a liquid carbon dioxide withdrawal line extending into said vessel and into said liquid carbon dioxide and a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel;

(b) a heating rod extending into said vessel and into said liquid carbon dioxide for heating said liquid carbon dioxide; and (c) refrigeration means having refrigeration coils located in said vessel for cooling said liquid carbon dioxide and said gaseous carbon dioxide.

9. The carbon dioxide storage and dispensing apparatus of claim 8 further comprising:

(a) a volume guage probe extending into said vessel and a volume guage mounted on said volume guage probe for determining the volume of liquid carbon dioxide in said vessel; and (b) a control mast extending into said vessel and a pressure bleed valve, a safety valve, a pressure sensor and a temperature guage carried by said control mast for monitoring pressure and temperature conditions inside said vessel.

10. The carbon dioxide storage and dispensing apparatus of claim 1 wherein said mixer means further comprises race means provided on said discharge end of said fill line; a mixer plate disposed beneath said discharge end of said fill line; bearing means fixedly attached to said mixer plate and engaging said race means in rotatable relationship; and a plurality of mixer blades fixedly attached to said mixer plate for receiving the liquid carbon dioxide from said fill line, rotating said mixer plate and said mixer blades on said discharge end of said fill line and dispersing said liquid carbon dioxide into said gaseous carbon dioxide.

11. The carbon dioxide storage and dispensing apparatus of claim 10 further comprising a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel.

12. The carbon dioxide storage and dispensing apparatus of claim 10 further comprising a heating rod extending into said vessel and into said liquid carbon dioxide for heating said liquid carbon dioxide and refrigeration means having refrigeration coils located in said vessel for cooling said liquid carbon dioxide and said gaseous carbon dioxide.

13. The carbon dioxide storage and dispensing apparatus of claim 10 further comprising:

(a) a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel; and (b) a heating rod extending into said vessel and into said liquid carbon dioxide for heating said liquid carbon dioxide and refrigeration means having refrigeration coils located in said vessel for cooling said liquid carbon dioxide and said gaseous carbon dioxide.

14. The carbon dioxide storage and dispensing apparatus of claim 13 further comprising a propeller fixedly carried by said mixer plate.

15. The carbon dioxide storage and dispensing apparatus of claim 13 further comprising:

(a) a volume guage probe extending into said vessel and a volume guage mounted on said volume guage probe for determining the volume of liquid carbon dioxide in said vessel; and (b) a control mast extending into said vessel and a pressure bleed valve, a safety valve, a pressure sensor and a temperature guage carried by said control mast for monitoring pressure and temperature conditions inside said vessel.

16. The carbon dioxide storage and dispensing container of claim 15 further comprising a pressure sensor line connecting said pressure sensor to said refrigeration means for automatically operating said refrigeration means when the pressure rises to a predetermined level in said vessel.

17. A carbon dioxide storage and dispensing apparatus comprising a storage vessel adapted to receive and store liquid and gaseous carbon dioxide; a fill line projecting into said storage vessel, with said fill line terminating in a discharge end located inside said storage vessel and the opposite end of said fill line adapted for connection to a source of liquid carbon dioxide; and mixer means carried by said discharge end of said fill line, for receiving a stream of liquid carbon dioxide flowing through said fill line from the source of carbon dioxide and dispersing said liquid carbon dioxide in said gaseous carbon dioxide to effect rapid thermal equilibrium between said liquid carbon dioxide and said gaseous carbon dioxide.

18. The carbon dioxide storage and dispensing apparatus of claim 17 wherein said mixer means further comprises a mixer plate disposed beneath said discharge nozzle for receiving the stream of liquid carbon dioxide, connecting means joining said mixer plate to said discharge nozzle in fixed relationship and a plurality of mixer blades provided on said mixer plate for receiving the stream of liquid carbon dioxide deflected from said mixer plate and mixing said stream of liquid carbon dioxide with said gaseous carbon dioxide in said storage vessel.

19. The carbon dioxide storage and dispensing apparatus of claim 18 further comprising:

(a) a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel;

(b) a heating rod extending into said vessel and into said liquid carbon dioxide for heating said liquid carbon dioxide; and (c) refrigeration means having refrigeration coils located in said vessel for cooling said liquid carbon dioxide and said gaseous carbon dioxide.

20. The carbon dioxide storage and dispensing apparatus of claim 19 further comprising:

(a) a volume guage probe extending into said vessel and a volume guage mounted on said volume guage probe for determining the volume of liquid carbon dioxide in said vessel; and (b) a control mast extending into said vessel and a pressure bleed valve, a safety valve, a pressure sensor and a temperature guage carried by said control mast for monitoring pressure and temperature conditions inside said vessel.

21. The carbon dioxide storage and dispensing apparatus of claim 20 further comprising a pressure sensor line connecting said pressure sensor to said refrigeration means for automatically operating said refrigeration means when the pressure rises to a predetermined level in said vessel.

22. The carbon dioxide storage and dispensing apparatus of claim 17 wherein said mixer means further comprises race means provided on said discharge end of said fill line; a mixer plate disposed beneath said discharge end of said fill line; bearing means fixedly attached to said mixer plate and engaging said race means in rotatable relationship; and a plurality of mixer blades fixedly attached to said mixer plate for receiving the liquid carbon dioxide from said fill line, rotating said mixer plate and said mixer blades on said discharge end of said fill line and dispersing said liquid carbon dioxide into said gaseous carbon dioxide.

23. The carbon dioxide storage and dispensing apparatus of claim 22 further comprising (a) a liquid carbon dioxide withdrawal line extending into said vessel and into said liquid carbon dioxide, a gaseous carbon dioxide withdrawal line extending into said vessel and into said gaseous carbon dioxide and valve means provided in said liquid carbon dioxide withdrawal line and said gaseous carbon dioxide withdrawal line for selectively removing liquid carbon dioxide and gaseous carbon dioxide from said vessel;

(b) a heating rod extending into said vessel and into said liquid carbon dioxide for heating said liquid carbon dioxide., and (c) refrigeration means having refrigeration coils located in said vessel for cooling said liquid carbon dioxide and said gaseous carbon dioxide.

24. The carbon dioxide storage and dispensing apparatus of claim 23 further comprising:

(a) a volume guage probe extending into said vessel and a volume guage mounted on said volume guage probe for determining the volume of liquid carbon dioxide in said vessel; and (b) a control mast extending into said vessel and a pressure bleed valve, a safety valve, a pressure sensor and a temperature guage carried by said control mast for monitoring pressure and temperature conditions inside said vessel.

25. The carbon dioxide storage and dispensing apparatus of claim 24 further comprising a propeller fixedly carried by said mixer plate.

26. The carbon dioxide storage and dispensing apparatus of claim 25 further comprising a pressure sensor line connecting said pressure sensor to said refrigeration means for automatically operating said refrigeration means when the pressure rises to a predetermined level in said vessel.

27. A method for filling a carbon dioxide storage and dispensing apparatus in an optimum manner comprising the steps of providing a storage vessel adapted to receive and store liquid and gaseous carbon dioxide; providing a fill line projecting into said storage vessel, with said fill line terminating in a discharge end located inside said storage vessel and the opposite end of said fill line adapted for connection to a source of liquid carbon dioxide; and mounting a mixer means on said discharge end of said fill line, for receiving a stream of liquid carbon dioxide flowing through said fill line from the source of liquid carbon dioxide, dispersing said liquid carbon dioxide in said gaseous carbon dioxide and effecting rapid thermal equilibrium between said liquid carbon dioxide and said gaseous carbon dioxide.

28. The method according to claim 27 further comprising the step of inserting a heating rod in said vessel and providing heating means in association with said heating rod for selectively heating said liquid carbon dioxide.

29. The method according to claim 28 further comprising the step of inserting cooling coils in said vessel and providing refrigeration means in association with said cooling coils for selectively cooling said gaseous carbon dioxide.

30. The method according to claim 29 further comprising the step of providing a liquid carbon dioxide withdrawal line extending into said vessel and said liquid carbon dioxide, a gaseous carbon dioxide withdrawal line extending into said vessel and said gaseous carbon dioxide and valve means provided in said liquid carbon dioxide withdrawal line and said gaseous carbon dioxide withdrawal line for selectively removing liquid carbon dioxide and gaseous carbon dioxide from said vessel.

31. The method according to claim 30 further comprising the step of providing a volume guage probe extending into said vessel and said liquid carbon dioxide and a volume guage mounted on said volume guage probe for determining the volume of liquid carbon dioxide in said vessel, and further providing a control mast extending into said vessel and a pressure bleed valve, a safety valve, a pressure sensor and a temperature guage each provided on said control mast for monitoring pressure and temperature conditions inside said vessel.

* * * * *